United States Patent [19]

Klaiss

[11] Patent Number: 4,486,000

[45] Date of Patent: Dec. 4, 1984

[54] FORMWORK SYSTEM FOR CONCRETE FLOORS COMPRISING A FLOOR JOIST

[75] Inventor: Dieter Klaiss, Stuttgart, Fed. Rep. of Germany

[73] Assignee: Peri-Werk Artur Schwörer GmbH & Co. KG, Weissenhorn, Fed. Rep. of Germany

[21] Appl. No.: 431,924

[22] Filed: Sep. 30, 1982

Related U.S. Application Data

[63] Continuation-in-part of Ser. No. 307,952, Oct. 2, 1981, abandoned.

[30] Foreign Application Priority Data

Oct. 10, 1980 [DE] Fed. Rep. of Germany ..... 3038348
Oct. 9, 1981 [DE] Fed. Rep. of Germany ..... 3140142

[51] Int. Cl.[3] ..... E04G 13/04
[52] U.S. Cl. ..... 249/23; 249/28; 249/137; 249/219 R
[58] Field of Search ..... 249/29, 48, 161, 162, 249/164, 165, 167, 219 R, 23, 28, 137

[56] References Cited

U.S. PATENT DOCUMENTS 1,816,921 8/1931 Urschel ..... 249/155
3,743,232 7/1973 Vaughn ..... 249/162

FOREIGN PATENT DOCUMENTS 48526 11/1972 Australia .
368755 2/1923 Fed. Rep. of Germany .
1739718 2/1957 Fed. Rep. of Germany .
1812837 6/1960 Fed. Rep. of Germany .
1832988 6/1961 Fed. Rep. of Germany .
1224021 9/1966 Fed. Rep. of Germany .
1803626 6/1970 Fed. Rep. of Germany .
100516 9/1973 Fed. Rep. of Germany .
3004245 8/1981 Fed. Rep. of Germany .
504330 7/1951 France .
1408912 7/1965 France .
408621 4/1934 United Kingdom .
673019 12/1949 United Kingdom .

*Primary Examiner*—John A. Parrish
*Attorney, Agent, or Firm*—Burmeister, York, Palmatier, Hamby & Jones

[57] ABSTRACT

A formwork system for a concrete floor provided with a floor joist, comprising side form elements for the lateral surfaces of the floor joist, the sheathing of the side form elements being fastened to frame pieces extending perpendicularly to the longitudinal axis of the floor joist, further bottom form elements having at least one sheathing for the underside of the floor joist, and devices for interconnecting the side form elements, characterized in that at least the side form elements (1, 2, 61, 130, 131) of one side are pivotally suspended from the ceiling formwork (girder 65) and that the side form elements are interconnected by fastening means (7, 9, 148) that can be released for stripping.

45 Claims, 24 Drawing Figures

FORMWORK SYSTEM FOR CONCRETE FLOORS COMPRISING A FLOOR JOIST

RELATED APPLICATION

This application is a continuation in part of application Ser. No. 307,952, filed Oct. 2, 1981, and now abandoned.

FIELD OF THE INVENTION

The present invention relates to a formwork system for a concrete floor provided with a floor joist, comprising side form elements for the lateral surfaces of the floor joist, the sheathing of the side form elements being fastened to frame pieces extending perpendicularly to the longitudinal axis of the floor joist, further bottom form elements having at least one sheathing for the underside of the floor joist, and devices for interconnecting the side form elements..

BACKGROUND OF THE INVENTION

It is a common problem of all floor joist formwork that its installation is a relative easy process in that the individual elements can be assembled on the ground, then lifted by a crane to the job site where they can be erected with relative ease with the aid of supports, while after completion of the concreting work the formwork must as a rule be removed by hand because it is no longer accessible by the crane due to the freshly concreted floor.

To permit the removal of known joist formwork a relatively important clearance is required. Therefore, to permit stripping of the lateral surfaces of the joist it will often be necessary to remove parts of the floor formwork. Further, the joist formwork is often provided with arms or plates projecting outwardly from their upper ends which are then propped by braces so that the latter finally bear the whole joist formwork. All these constraints have in the known joist formwork systems led to designs which do not exactly facilitate the installation of the formwork and are very difficult to remove. In known joist formwork systems, the side form elements are held together by joist clamps embracing them, the yokes of the clamps being adapted to be fastened to the frame pieces at selective heights. In a joist formwork of the said type known from a brochure of the firm Ischebeck, namely Titan U, the side bars and the yoke of the joist clamp must be adjusted to the height and width of the joist and then rigidly connected with each other, prior to installation of the clamp. Thereupon, the sheathing boards are nailed to the side bars and the yoke of the clamp, and plates arranged at the upper end of the side bars of the clamps are interconnected by squared timber. The finished form, now completely stiff, is then moved by a crane to the job site to be erected with the aid of braces acting upon the squared timber. Since this type of joist form is completely rigid at the site where it is used, it can be hardly clamped together with the floor form for the purpose of sealing the joints. In addition, making this type of joist form and installing it in the floor form requires a substantial amount of work hours. Moreover, this prior art joist form is also extremely heavy and no longer suited for handling by manual labour.

A similar design offered by the firm of Heilwagen which likewise uses the principle of the clamp embracing the formwork and which is also completely assembled on the ground and then moved by a crane to the job site, is said to facilitate the stripping work in that the side bars can be laterally displaced a certain distance at the crossing points between the side bars and the yoke of the joist clamp embracing the lateral form elements, and also lowered a certain distance so as to provide sufficient clearance between the individual elements of the joist formwork and the freshly cast joist to enable the side form elements to be removed. As mentioned before, however, this known formwork comprises plates projecting outwardly from the upper end of the side form elements for being supported by beam-shaped longitudinal girders which in turn are propped by braces. So, these braces must be removed first as they would otherwise prevent any lateral displacement of the side form elements. This means, however, that the yoke of the subfloor clamp must be necessarily supported before these braces are removed, for instance by means of the lifting truck mentioned in the relevent brochure which then serves to remove the formwork as one unit, without having been taken apart.

SUMMARY OF THE INVENTION

It is the object of the present invention to provide a joist form which can be readily installed in the floor form and easily removed therefrom upon completion of the concreting work, which is easy to handle and yet is precise and stable enough to maintain correct measurements.

This is accomplished according to the invention in that at least the side form elements of one side are suspended from the ceiling form and that the side form elements are interconnected by fastening means that can be removed for stripping.

It is a particular advantage of the invention that the pivotal suspension of the side form elements from the ceiling form permits the joist form to be assembled on the job site so that the individual components of the formwork can be transported on the job site in sizes that can be easily handled. The installation of the joist form is very easy because the side form elements can be effortlessly pivoted to conform the joist form to the required measurements, at least in the lower region of the form. The removal of the joist forms which is so difficult in the known formwork systems is also effected with ease as after untightening the fastening means by which the lower end of the form was held together one only has to pivot the side form elements outwardly to permit their removal.

While in the known formwork, the braces bear against the longitudinal beam laterally fastened to the joist formwork so that they must necessarily be positioned close to the side form elements, this is not necessary in the arrangement of the invention because here the side form elements are individually suspended from the ceiling form. Accordingly, there are no braces directly bearing upon the joist form that could hinder the outwardly directed pivotal movement of the side form elements.

Since the floor form of the invention does without the longitudinal beam required in the known joist formwork so that the side form element may have a length smaller than the distance between two neighbouring braces supporting the floor form, the freely suspended flanks of the side form elements may, if such a big pivot angle is required for removing the side form elements, be pivoted into the clearance between two floor braces. Whenever a side form element is installed in the area of a floor brace, it may, after its neighbouring side form element has been removed, be pushed into the latter's position and then removed by the described pivotal movement into the space between two floor braces. This is not possible for the known joist forms after Heilwagen because here the braces bear directly upon the longitudinal beams so that the braces cannot be spaced at distances greater than the length of the longitudinal beam as in this case the beam of one side form element would evidently not be supported.

Considering that in the known joist form the side form elements, after having been lowered and laterally displaced, are still held in the yoke they cannot, of course, be disengaged from the clamp without difficulty. In contrast, the formwork of the invention offers the possibility to remove first the bottom of the joist form and then the still suspended side form elements, one by one. So, the elements of the joist form can be individually removed and, provided they have been properly sized, easily transported by hand, without the need to brace certain parts additionally during the stripping work and without any risk that any unsecured elements could fall down unintentionally during stripping.

The pivotal movement required in the formwork of the invention for removal of the side form elements during stripping may be accomplished in different ways in the different embodiments of the invention.

In one embodiment of the invention, the side form element, in addition to being pivotally suspended on the floor form, includes a flank forming a section of the floor form and provided with projections and/or bearing means for co-operation with bearing means and/or projections on a part of the floor form so that these cooperating parts form a defined pivot axis. This embodiment of the invention may be further modified in that the cooperating pivot components consist of mutually engaging members of hook-like cross-section; in particular, the means arranged on the floor form for pivotally suspending the side form element may comprise parts of hook-like cross-section.

These embodiments offer the advantage that the parts defining the pivot axis may have enough play to favour the pivotal movement and also the ready installation of the side form elements from above, while being still capable of transferring the tensional forces occurring in the plane of the floor formwork.

In certain other embodiments of the invention, the pivot axis may extend either in the immediate neighbourhood of, or at a distance from, the end of the horizontal flank facing away from the joist. In still other embodiments of the invention, the pivot axis may extend in or in the immediate neighbourhood of the sheathing of the horizontal flank, or at a distance from the sheathing of the floor form, for instance on the bottom face of the horizontal flank or below the end of the horizontal flank facing away from the joist.

When the pivot axis of an embodiment of the invention extends in the sheathing plane or in the direct neighbourhood of the sheathing plane and at the end of the horizontal flank, the outwardly directed pivotal movement can be easily performed during the stripping work when the fastening means holding the lower ends of the vertical flanks of the side form elements together have been released. Theoretically, no play would be required to this end, provided the pivot axis extends exactly in the sheathing plane. In practice, however, this is rather difficult to accomplish and the cooperating parts forming the pivot axis exhibit usually some play. When the sheathing surface of the horizontal flank and the sheathing surface of the vertical flank of the side form element form between them, at their common edge, a right angle, the required stripping play must become greater with rising distance between the pivot axis and the sheathing of the horizontal flank. However, no particular measures to gain such play will be required when, according to one embodiment of the invention, the edge formed between the horizontal and the vertical flanks of the side form element is not defined by straight lines forming between them a right angle, but rather by an arc of a circle the radius of which passes through the pivot axis. In practice, this will be approximately realized in that according to one embodiment of the invention a haunch is provided at this point instead of the arc of a circle, the said haunch and the horizontal and vertical sheathing surfaces being arranged around the pivot axis along a line similar to an arc of a circle. In certain embodiments of the invention, the inclined face of the haunch may, however, also extend beyond the line containing the foot of the perpendicular drawn from the pivot axis to the vertical sheathing surface, and over the full height of the vertical element. For, the inclination of the haunch face relative to the vertical surface is extremely small in elements of usual size when the pivot axis extends along the lower edge of the end face, at the end of the horizontal flank. But even if the horizontal sheathing surface should at its inner end form an exact right angle instead of gradually turning into an inclined face, no additional measures aimed at gaining such stripping play will be required provided the pivot axis does not extend at too great a distance below the horizontal sheathing plane. A floor form is generally relatively soft with respect to forces acting in the sheathing plane so that the floor form will yield a little in the beforementioned case even if all panels of the floor form are still in place and none has been removed. In particular, no additional measures will be required if according to one embodiment of the invention the forming surface of the flank of the frame pieces of the side form element extending in parallel to the lateral surfaces of the floor joist and vertically to its longitudinal axis extends vertically to the perpendicular drawn from the edge formed between the said flank and the flank which extends in parallel to the floor form upon the pivot axis.

If, however, the pivot axis is not located in the end portion of the horizontal flank so that a stripping play is required in a direction vertical to the horizontal sheathing, or if an increased stripping play is desired in the horizontal direction, the side form elements may, according to one embodiment of the invention, be suspended on a part of the floor form, for instance a floor beam, connected to a bulkhead. Bulkheads of this type are mounted on a floor brace for vertical displacement so that they, and with them the parts of the floor form fastened to the bulkheads, can be lowered a certain distance, while the floor is still being supported by the upper face of the brace. Now, when the vertical flank of the side form element does not extend exactly vertically, but rather at a slight angle to the perpendicular, the mere lowering of the cooperating parts forming the pivot axis will already provide an additional stripping play in the horizontal direction.

According to another embodiment of the invention, however, the maximum thickness of the horizontal flank of the side form elements constituting a section of the floor form is reduced by an amount equal to the drop height of the bulkhead so that this horizontal flank may be moved for stripping purposes past the edge of the sheathing of the floor form. The length of the flank can be so selected that the side form element can be pivoted about the upper edge of the surface of the floor form element facing the floor joist by an amount such that the horizontal section of the side form element is removable from the floor form from between the edge of the floor form and the floor joist. Thus, during the stripping operation, the entire floor form can be lowered by first lowering the bulkhead, in conventional manner. Then the side form elements which are hung into the floor form, i.e. normally suspended on a hook with open top, may be lifted, whereupon the horizontal flank is pushed over the adjacent floor form element and the lower end portion of the side form element is pivoted outwardly a great distance. This ensures a particularly easy removal of the floor joist formwork of the invention.

The angular shape of the side form element and its suspension on the outer end portion of the horizontal flank has the advantage that the vertical flank of the side form element slants outwardly after it is hung from the floor form so that the bottom ends of the oppositely arranged side form elements are spaced farther apart than their tops. This has the effect that in those embodiments in which the lower end portions of the side form elements are pressed together by means of a clamp, these ends tend to lean against the side bars of the clamp and, as the clamp is being tensioned, i.e. as the side form elements move inwardly, to remain in engagement with the side bars of the clamp which overlap the lower ends of the side form elements. This feature offers essential advantages which will be described in detail hereafter.

The side form element may be suspended upon a beam of the floor form, but may in part also be suspended directly on the bulkhead of a floor brace.

In one embodiment of the invention, the swinging movement of the side form elements in the direction of the floor joist about their suspension point in the floor form is limited by abutment means to the position in which the side form element forms the desired angle with the adjacent floor form element. Due to this abutment means, the desired angle which in most instances will be a right one, will be formed automatically as the vertical flanks of the side form elements are clamped together.

The abutment means for limiting the pivotal movement of the side form element may be provided on a structural part which is not a component part of the side form element or the floor form element. The just described embodiment, however, may be further modified so that the stop means will be effective between the side form element and the floor form element in a manner such that upon reaching the desired angular position and hence limiting the extent of pivotability, the previously hinged joint will become a rigid angle connection. If in this position the dimension of the underside of the floor joist is not quite reached yet, that is, if the side form element may still be moved farther inwardly some slight extent when the clamp is further tightened, this movement is no longer brought about by the pivotal motion of the side form element. Rather, the side form element, now in a rigid angular position with respect to the adjacent floor form element, performs a translational movement in the direction towards the floor joist pulling the floor form element along, which is now rigidly joined to it by way of the pivot axis and is supported by braces. The floor form element is free to follow this translational motion because the sheathing is "soft" in this direction, and the braces for the floor form will yieldably slant during this minor corrective movement, without noticeable adverse effects.

In a further improvement of this embodiment of the invention, the limitation of the pivotal movement is achieved by the fact that the side face of the floor beam comes to rest against a ledge connecting the crosspieces of the side form element and forming the end face of its horizontal flank.

The pivotal suspension of the side form element from the floor form is of a character such that this hinged joint is capable of absorbing the tensional forces occurring as the tensional movement comes to a halt, and transferring them to the floor formwork.

If in one embodiment of the invention, the side form element is suspended from a supporting member of the floor form (floor beam) and the pivot axis for the pivotal movement is spaced a distance from the sheathing of the floor form, the leading surfaces of the floor form located above the pivot axis and the leading surfaces of the horizontal section of the side form elements may, in certain embodiments of the invention, be so oriented by simple means that such leading surfaces will abut each other to limit the inwardly directed pivotal movement and, thus, form the stop means for limiting said pivotal movement in this direction.

In detail, certain embodiments of the invention may be improved in that the floor beam is provided on its lateral surface area, at a distance from the sheathing, with upwardly opening hooks for engagement with the side form element. The flank of the side form element constituting part of the floor form may be provided on its underside with a bar projecting downwardly and latching into a hook. This embodiment may further be modified in that the bar is connected to the frame pieces of the side form elements by means of crossbars extending tranversely to the longitudinal axis of the floor joist, the crossbar being preferably formed by portions bent off at an angle from the upper end of the beam. The crossbars are provided at their bottom edges with a recess for receiving the hooks attached to the floor form beam. Located adjacent this recess may be another recess, less deep than the first one. This second recess then forms part of the hinged joint betweeen the side form elements and the floor form when the floor form element adjacent the side form element does not have hooks and the horizontal flank of the side form element must be placed on a bar instead.

In another embodiment of the invention, the crossbars angularly projecting from the beam of the side form element carry the sheathing of the roof form section formed by the said side form element, and the ends of the crossbars of adjacent beams are interconnected, preferably in pairs, by a bar. This embodiment may be further modified in that the distance of the hooks on the longitudinal floor beam is shorter than the length of the bar supported by the hooks. This arrangement enables the side form elements to be moved at will along the plane of the formwork, without being confined to a position determined by the hooks.

In one embodiment of the invention, the bottom form elements are longer than the side form elements. As the lower ends of the side form elements are tensioned against the end faces of the bottom form element, it is ensured by this arrangement that the bottom form element align the side form elements in the longitudinal direction and that this alignment is transferred to the floor form via joints which are rigid when the clamps are tensioned.

In certain embodiments of the invention, the horizontal and/or vertical sheathing sections may be adapted to be fastened to the side form element after the latter has been suspended. Considering that the floor joist formwork is generally assembled at the job site in that in a first step the side form elements are suspended and, in a second step, the floor joist is fastened and the lower ends of the side form elements are pressed together, the individual components that must be transported to the job site should conveniently be as light as possible, a requirement that can be fulfilled when the sheathing is fastened only after the side form elements have been hung up.

Closing of the floor joist formwork at the lower ends of the side form elements may be effected in the formwork system of the invention in various manners. In one embodiment of the invention, this is done by means of a device which uses the known principle of the joist clamps, the yoke of the clamp being adapted for being fastened to the side form elements at selectable height. This embodiment can be further improved according to the invention in a manner such that the yoke of the clamp can be brought into its clamping position at the suspended side form elements from below and that the effective length of the clamp yoke can be adjusted. This feature, namely that the clamp can be positioned on the suspended side form elements from below, facilitates considerably the assembly of the floor joist formwork at the job site. And the clamp can also be easily fastened from below on the side form elements suspended from the floor form. The lower ends of the side form elements can be pivoted inwardly simultaneously with the adjustment of the clamp yoke to the correct length.

The adjustability of the clamp yoke to its effective length can be achieved in different ways.

In one embodiment of the invention, the yoke of the clamp consists of two slidably movable sections arranged on a yoke bar. This offers the advantage that the two sections may be of identical design.

The two yoke sections are guided on the yoke with a relatively large extent of lateral play so that the sliding movement will not be easily affected by lateral tilting.

The yoke sections may be locked in position by means of pins inserted into holes provided in an aligned relationship on each rod section, or by means of a tie rod axially extending through the hollow interior of the yoke and having tightening means on its ends. In one embodiment of the invention, the yoke sections are locked in position relative to each other by means of wedges driven in after the yoke has been adjusted to its correct length.

These embodiments of the invention have the advantage that the length of the clamp yoke can be continuously adjusted, and the telescopically slidable yoke sections may be locked in a simple fashion.

The inwardly directed pivotal movement of the side form elements brought about by the tightening of the clamp as the floor joist formwork is being erected may be limited by abutments or stops. In one embodiment of the invention, the bottom element of the floor joist formwork is disposed between the lower ends of the side form elements so that these ends are butted against the bottom element as the clamp is tightened. This has the advantage that not only the joint formed by the bottom form and the side form is completely tight, and may even be tightened with a bias to accommodate the pressure of the concrete during the pouring and vibrating operations, but also that the spacing between the lower ends of the side form elements need not be specifically determined but will be brought about automatically by placing the side form elements against the bottom form element.

If the means by which the clamp is able to engage the lower ends of the side form elements at a certain height are designed in such a manner that a horizontal motion will cause these means to move into operative engagement with each other, the tendency of the lower ends of the side form elements to lean against those parts of the clamp which are applied against the outsides of the side form elements will ensure that the height fastening means of the clamp are engaged in any pivotal position of the side form elements so that the clamp, once applied, is secured in its vertical position and prevented from falling down.

The height adjustable fastening of the floor joist clamp may be effected in various ways, but it is of importance that the clamp can be inserted and brought in position with respect to the floor joist formwork from below and can be tensioned in this position. The clamp yoke may be directly fastened to frame pieces of the side form elements. These frame pieces may then be made longer so as to extend past the lower end of the sheathing, thereby directly constituting the side portions of the clamp. It is also possible to rigidly attach the side parts or legs of the clamp to the slidably movable yoke sections. These legs in turn may be fastened to the back of the side form elements at selectable heights. The legs, which are rigidly attached to the yoke in an angular position, not only function to effect the fastening of the clamp in an elevated position, but also function to lock the side form element in a certain angular position, so that these clamp legs also act, as the clamp is being tensioned, to limit the inwardly directed swinging movement of the side form elements about their pivot axis and, upon further tightening of the clamp, to also pull along the floor form elements. For this purpose, the clamp legs may conveniently be provided with two stops contacting the back of the side form elements at different elevations. Preferably, one stop will be disposed below the sheathing plane of the floor joist formwork, while the other stop will be disposed above this plane.

The embodiments of the invention may further be modified by providing the frame pieces of the side form elements with teeth projecting outwardly at a right angle to the longitudinal axis of the floor joist formwork, such teeth serving to select the height of the fastening position of the bottom form element.

The spacing of the teeth may expediently be from 2 to 3 cm. This has the advantage that the position of a clamp hung onto a wrong tooth deviates relatively sharply from the position of the other clamps and is immediately visible. In a modification of this embodiment, the telescopic sections of the yoke have attached thereto perpendicularly extending bars for engaging the serrations on the frame piece. This enables the clamp to be secured even if it has not been accurately applied to the plane defined by the rows of teeth on the oppositely disposed side form elements of the floor joist formwork. Rather, the clamp may also be applied at a distance from these rows of teeth as may be permitted by the length of the transversely extending bar. It is thus not necessary that the rows of teeth arranged on each side of the floor joist formwork are aligned with each other in a direction transverse to the longitudinal direction of the form.

Of course, other fastening means for securing the clamp in a selected vertical position may also be used such as, for example, perforated rails the holes of which receive bolts for the direct fastening of either the side bars or the yoke of the clamp.

The bar engaging the serrations may be disposed above or below the clamp yoke; however, it can be below the yoke only if the frame pieces extend past the lower edge of the sheathing of the side floor element and if their extensions are provided with teeth.

As previously mentioned, in one embodiment of the invention the two yoke sections of the clamp are provided with stops at a distance above the sheathing of the bottom form and oriented at a fixed angle to the longitudinal axis of the yoke. Such stops serve to engage the surface of the side form element facing away from the sheathing and are so disposed that in the tightened condition of the clamp the side form element stands at the desired angle, normally a right angle. The distance between the two form elements is determined by the width of the sheathing of the bottom element of the form. Tightening the clamp has the effect that the side form element is pulled along by the upper stop provided on the clamp legs, and possibly also the floor form together with the frame pieces, since the frame pieces at their upper ends are not rigidly anchored to the floor form. Thus, in the embodiment of the invention, provided the lower end of the side form element is in engagement with the sheathing of the bottom element, the inwardly directed pivotal movement of the side form element is limited on the one hand by the contact between the side form element and the floor form and, on the other hand, by the abutment of the side form element against the bottom form element. These stop means may also in certain embodiments of the invention consist of a transversely extending bar, and the distance of the stop means from the lower end of the sheathing of the side form element may be about one third of the height of the side form element.

The clamp sections may be provided with two stops acting at different heights upon the rear face of the side form elements. In further improvements of this embodiment of the invention the arrangement of the stops may be such that one of them acts upon the rear face of the side form element above, the other one below, the plane of the sheathing of the bottom form element.

In some embodiments of the invention, the floor joist formwork may be held together by individual clamps. In other embodiments, however, two adjacently located clamps are rigidly joined together in pairs, for instance, by means of the bar engaging the teeth on the frame pieces, and/or by the bar disposed above the yoke and transversely to the longitudinal direction of the yoke, forming the stop means that is operative on the back of the side form element. Since in this instance the bars are always longer than the distance between two frame pieces of the side form element, it is not necessary that the side form elements for the floor joist structure are exactly opposite each other; rather, the position of the side floor element alongside the lateral surface of the floor joist structure is completely independent of the particular location of the opposite side form element. This is of particular advantage when, due to any lateral projections provided on the floor joist structure, the continuous lateral faces of the floor joist structure are not of equal length on both sides.

In one embodiment of the invention, the bottom form element consists of lengths of squared timber placed on the clamp yokes and loosely covered with sheathing. In some embodiments, the squared timber may likewise be placed loosely upon the clamp yoke, or may also be fastened to the yoke. The former case makes for an especially easy handling of the floor joist formwork according to the invention. Moreover, this arrangement has the advantage that the squared timber poses no problem where the floor joist structure is so narrow that it is flush with the side face of a concrete support member, that is, the side form elements are so close together that they are in abutment with the side faces of a concrete support member. The floor joist formwork elements may be provided solely with a sheathing; or they may have, in addition, also frame pieces providing support for the sheathing. It is not necessary that the floor joist formwork elements are supported by the yoke of the clamp. Rather, in one embodiment of the invention, bars or bearing strips are nailed to the inner surface of the sheathing of the side form elements for supporting the sheathing of the bottom form element, or the bottom form element in its entirety, when the side form elements are pivoted inwardly.

The particular advantage of this embodiment of the invention resides in the features that the width of the floor joist may be defined by cutting the bottom sheathing to the proper measurement, the sheathing extending over a plurality of lengths of the side form elements, and that the other dimensions can be accurately maintained due to the automatic adjustment of the side form elements to this measurement. Similarly, the vertical dimensions of the floor joist formworks may be adjusted with ease by virtue of the detachable fastening of the clamp on the teeth of the side form elements at a selectable height, and this level may further be varied depending on the vertical dimension of the squared timber disposed on the clamp yokes, or by suitable intermediate layers.

Finally, in one embodiment of the invention, the serrated section of the side form element is provided on its bottom end with a flange-like projection extending past the length of the teeth and acting as a safeguard to prevent the clamp from falling out as a result of a mishandling of the clamp and in spite of the tendency of the side form elements to lean into the fastening means acting from the outside. This projection may be constituted, according to one embodiment of the invention, by a plate disposed on the lower end of the frame piece extension. The plate functions simultaneously as a shoe for the side form element.

In the group of embodiments described hereafter, closing of the bottom form at the lower ends of the side form elements is not effected by a joist clamp applied from the outside upon the side form elements. Rather, the side form elements are detachably interconnected by bottom supporting elements extending from the inner face of the one side form element to the inner face of the other side form element, and at least one of the fastening means connecting the one end of the bottom supporting element with the neighbouring side form element can be released for stripping purposes. This enables the floor joist formwork to be disassembled during the stripping process into components of a size that can be easily handled. To this end, one first releases the connection between the one end of the bottom supporting element and the neighbouring side form element and pivots the side form elements outwardly, if necessary after lowering the floor form. Then the sheathing of the floor joist formwork element supported by the bottom supporting elements and, if necessary, the longitudinal beams arranged between the said sheathing and the bottom supporting elements are removed, whereafter the side form elements are disengaged and removed, if necessary after having first removed the bottom supporting elements which have been still fastened with their one end to one side element. In this embodiment of the invention, essential components of the formwork, namely the side form elements, are again easily handled during the assembly and disassembly of the formwork, grace to their suspended arrangement.

In another embodiment of the invention, holes passing also through the sheathing are provided for receiving the fastening means connecting the bottom supporting elements with the side form elements. This offers the advantage that the sheathing for the lateral faces of the floor joist can extend far downwardly, in one embodiment of the invention over the full length corresponding to the maximum height of the floor joist for which the formwork is still suited. The holes in the sheathing which are not used at any time are closed by plugs. It is an advantage of this embodiment of the invention that the same side form elements may be used for installing the forms for floor joists of different heights and that, in addition, the sheathing need no longer be adapted to the respective height of the floor joist because the bottom form element, i.e. the form bottom can be mounted at any desired height between the two side form elements, without this fastening process being obstructed in any way by the length of sheathing extending farther downwards. The sheathing may be permanently fastened, for instance riveted, to supporting metal sections.

In one embodiment of the invention, the downward extension of the sheathing is such that its lower edge is positioned on the upper edge of a bottom supporting element mounted in its lowermost position on the side pieces.

The bottom supporting elements may be fastened to the side form elements in different ways. In one embodiment of the invention, the end faces of the bottom supporting elements are provided with a plate extending over several holes in the sheathing. The plate is provided with a row of holes which rows are spaced at a distance smaller than the distance of the holes in the sheathing. So, the height of the formbottom may be selected in very small steps.

The bottom supporting elements themselves may also be designed in various ways. A design that has been found to be particularly advantageous comprises two upright plates fastened to each other in offset arrangement and comprising at least two superimposed rows of holes, the holes of the one plate being spaced at a distance somewhat different from the distance of the holes in the other plate. This arrangement warrants an easy adjustment of the length of the bottom supporting element, also in very small steps.

The before-described embodiment of the invention may be further improved in that the edges of the plates are folded to reinforce them. Due to the fact that the holes in the sheathing are provided in the area of the vertical frame pieces of the side form elements and also pass through them, a structure of great flexural stiffness will be obtained already when the bottom supporting elements are fastened, for instance, by only two keybolts or screws so that when erecting the formwork it will be even possible to fasten the bottom form element comprising the bottom supporting elements only on its one end, to support its free end by a brace and to apply the reinforcement for the floor joist on the bottom form element.

It is essential in all these embodiments comprising the bottom supporting elements extending from one inner face to the other inner face of the side form elements that these bottom supporting elements and their detachable fastening means act to draw the bottom form together without requiring any clamp-like constructions embracing the side form elements and applied to their rear faces. Nevertheless, this embodiment also provides the advantage achieved by the clamp-like arrangements, namely that the bottom form element can be clamped at any desired height between the sheathings of the side form elements, and this because of the fact that the fastening means for the bottom supporting elements pass through holes in the sheathing—a solution which was heretofore avoided.

BRIEF DESCRIPTION OF THE DRAWINGS

Further objects, advantages and features of the present invention will appear from the following description of certain embodiments of the invention as well as the claims and the drawing which shows certain details essential to the invention. The individual features may be realized in an embodiment of the invention either individually or in any desired combination. In the drawings

DETAILED DESCRIPTION OF ILLUSTRATIVE EMBODIMENTS

Figure 1:
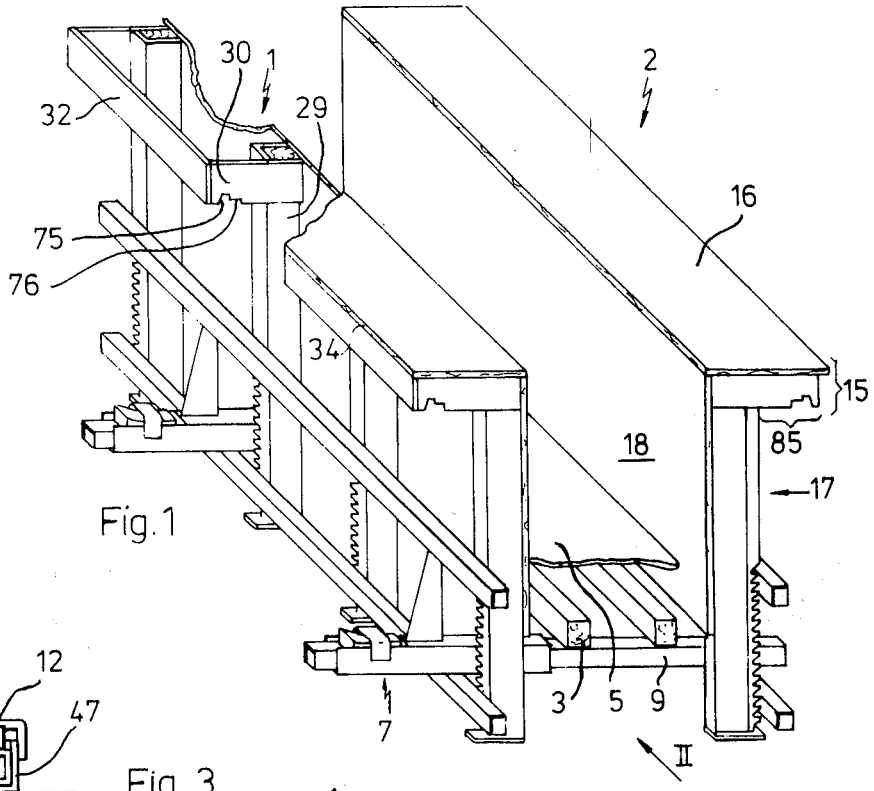
FIG. 1 is a perspective view of an embodiment of the floor joist formwork according to the invention, partly broken away.
Figure 2:
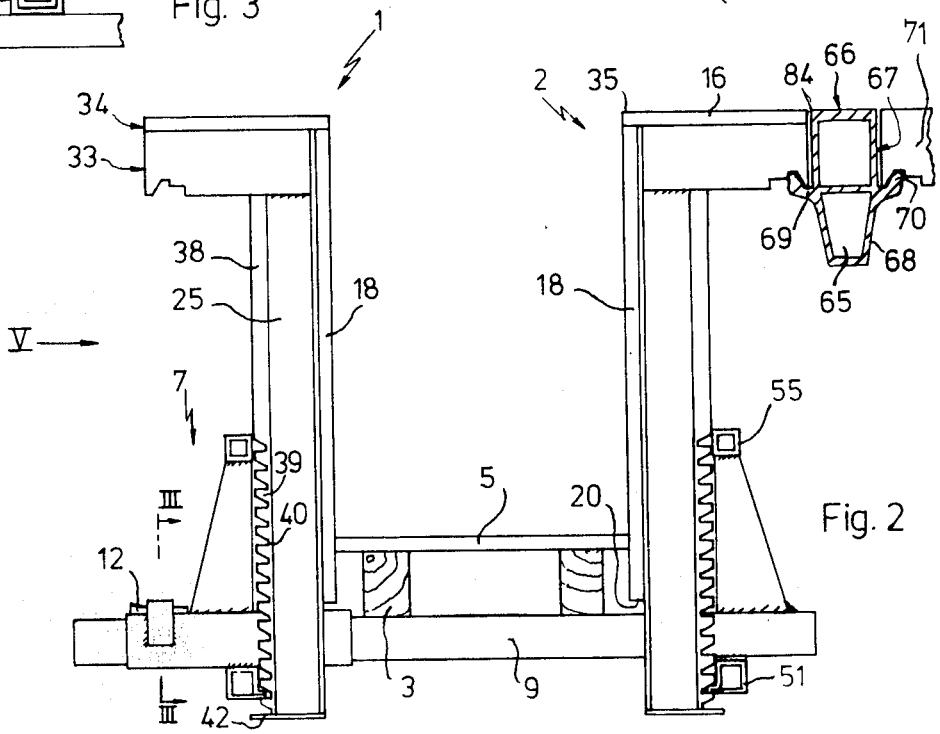
FIG. 2 is a view in the direction of the arrow II in FIG. 1.
Figure 7:
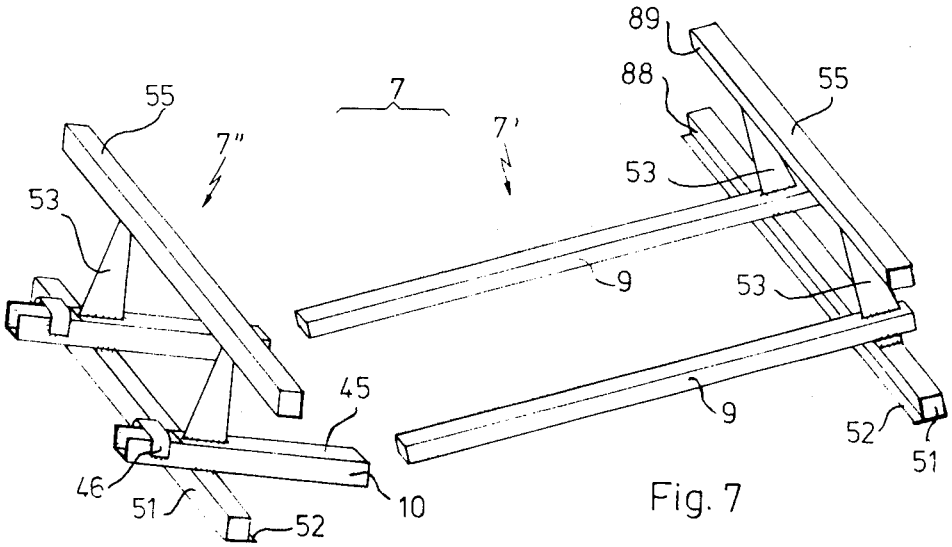
FIG. 7 is a perspective view of the floor joist clamp in its disassembled condition.

Referring to the drawings, the floor joist formwork shown in its assembled condition in FIGS. 1 and 2 comprises two identically constructed side form elements 1 and 2 erected in a spaced parallel relationship to one another. Positioned in the space between the two side form elements 1 and 2 is a bottom form element comprised of lengths of squared timber 3 covered by a sheathing 5. The two side form elements 1 and 2 are held together by a double clamp 7, which is shown in its disassembled condition in FIG. 7. Long yoke sections 9 of the clamp 7, providing support for the beams 3, form a part of the right hand portion of the double or twin clamp, as viewed in FIGS. 1, 2 and 7, and can be inserted into short yoke sections 10 forming a part of the left hand portion of the double clamp 7, as illustrated in FIGS. 1, 2 and 7, and locked against displacement by a wedge 12. The twin clamp 7 operates to firmly hold the two side form elements 1 and 2 in close contact with the sheathing 5.

The side form elements 1 and 2 are each provided at their upper ends with horizontal frame pieces 15 covered by a horizontal sheathing section 16 which constitutes part of the form system for the floor or ceiling immediately adjacent the floor joist. Disposed at a right angle to the horizontal frame piece 15 is a vertical frame piece 17 to which a sheathing section 18 is fastened, extending in a vertical plane. The frame piece 17 is a part of the side form for the floor joist to be constructed. If the side face of the floor joist is to form an angle with the underside of the concrete floor or ceiling other than 90° and/or the underside of the floor or ceiling is not intended to be horizontal, the angle formed with the frame pieces 15 and 17 may be different from the angle in the illustrated embodiment. The lowermost portion of the vertical sheathing 18 is generally not in contact with the concrete, because the sheathing 5 of the bottom form element joins the sheathing 18 at a level well above the lower edge 20 of the sheathing 18.

Figure 6:
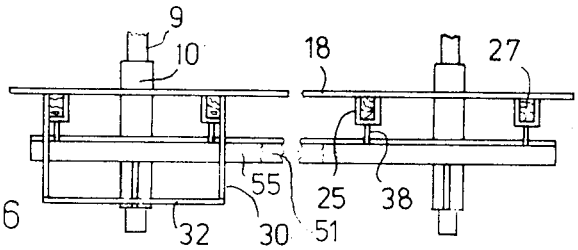
FIG. 6 is a sectional view of the side form element, taken along the line VI—VI in FIG. 5.

The vertical sheathing 18 is fastened to spaced vertical frame pieces 25 provided with a recess opening toward the sheathing 18 to receive a piece of lumber 27 that provides a nailing surface for the plywood sheathing 18, as shown in FIG. 6. Instead of plywood panels shuttering boards may also be used. In that case, by removing or adding any desired number of boards of, say, 10 cm width, the lower edge 20 of the sheathing 18 may easily be moved up or down, respectively.

The side form elements 1 and 2 are each supported by four frame pieces 25. Each two of the frame pieces 25 have a frame piece 30 fastened to their opposite side faces 29 extending vertically and crosswise to the plane of the sheathing 18. The ends of each two of the frame pieces 30 facing away from the sheathing 18 are connected by a bar 32 extending parallel with the sheathing 18. The frame piece 30 and the bar 32 are made of a heavy gauge sheet metal. The top faces of the frame pieces 30 and the bar 32 serve as a support for the horizontal sheathing 16. The face 33 of the bar 32 turned away from the sheathing 18 is flush with the front edge 34 of the horizontal sheathing 16. In the longitudinal direction of the floor joist formwork, i.e. viewed in the direction of the edge 35 formed between the sheathing sections 16 and 18, the latter project slightly over the foremost and the rearmost frame pieces 25 and the foremost and rearmost frame pieces 30, as will be seen from FIGS. 1 and 5 in the area of the rear frame piece 25 and the rear forward frame piece 30, respectively. This overhang may amount to 10 cm, for example. While the bar 32 is not running the entire length of the side form elements shown in FIGS. 1 and 2, the sheathings 16 and 18 do cover the entire length of the side form elements 1, 2, bridging the gap between the two middle frame pieces 25 which are not connected by the bar 32. The lower edge of the sheathing 18 is short of the lower ends of the frame pieces 25.

Figure 4:
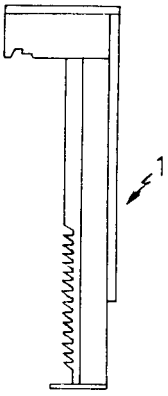
FIG. 4 shows a side form element as viewed in the direction of FIG. 2.

Fastened to the backs of the frame pieces 25 are bars 38 extending parallel with and over the entire height of the frame pieces 25. In about its lower half, the bar 38 is provided with serrations or teeth 39 produced by cutting or milling and pointing rearward and transverse to the plane of the sheathing 18. The spacing of the teeth 39, measured from tooth base to tooth base, is 25 mm in the illustrated embodiment. The particular shape of the teeth 39 may be selected from a wide range of configurations; it is merely required that the toothed edge provide sufficient support for the double clamp 7 to be described in greater detail hereinafter. Welded to the bottom end of the frame piece 25 is a shoe plate 42 projecting rearwardly past the horizontal dimension of the teeth 39. This plate functions as an additional safeguard in the installation of the floor joist form, as will further be explained below. Moreover, the shoe plate 42 permits the side form elements 1, 2 to be set onto a level base in the position shown in FIG. 4, which may prove expedient at a time immediately before commencing with the work proper.

A favorable shape of the teeth 39 is shown in FIG. 2, while in the other Figures the teeth are indicated only schematically.

Figure 3:
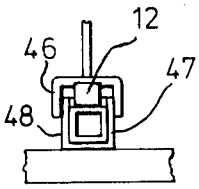
FIG. 3 is a sectional view along the line III—III in FIG. 2.
Figure 8:
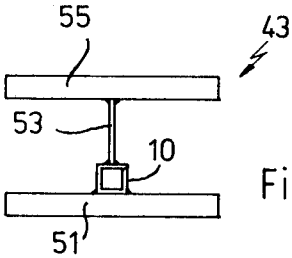
FIG. 8 illustrates another embodiment of a floor joist formwork clamp as viewed in a direction similar to FIG. 5.

The structure illustrated in FIG. 7 is designated as double clamp 7 because it comprises two yokes, each consisting of a long section 9 and a short section 10, whereas the single clamp 43 of FIG. 8 has only one yoke. By cutting the double clamp 7 shown in FIG. 7 in a suitable manner, two of the single clamps 43 shown in FIG. 8 could be obtained. The yoke sections 9 and 10 are each in the form of a hollow tube of square or rectangular cross section. The longer sections 9 are adapted to be slidably inserted into the shorter sections 10 so as to be slidable therein. The free end of the shorter section 10, i.e. on the left in FIG. 7, has part of its top face 45 cut away. In this area, a stirrup like member 46 is welded to the two sides 47 and 48 of the short rod section 10. This stirrup 46 is in operative coaction with the wedge 12 in a manner such that the long yoke section 9 may be clamped tight within the short yoke section 10 at any length, as the wedge 12 is driven into position, i.e. toward the right as viewed in FIG. 2. See also FIG. 3.

The two long yoke sections 9 of the right hand portion 7′ in FIG. 7 are disposed parallel at a distance from each other and are linked by a bar 51, which has a substantially square cross section and is welded to the underside of the right-hand end portions, as viewed in FIG. 7, of each of the yoke sections 9. The bar 51 has a bar-shaped projection 52, pointing toward the left in FIG. 7, to engage the space 40 between the teeth 39. Welded to the top surface of the long yoke sections, which faces away from the bar 51, are spacers 53 carrying on their upper ends another bar 55 in parallel with the bar 51. The plane defined by the two long yoke sections 9 stands perpendicular to the plane defined by the two bars 51 and 55.

In similar fashion, the short yoke sections 10 are likewise in parallel spaced relationship to each other. Secured to their undersides is a bar having a flange 52 thereon. Secured to their upper side and separated by spacers is a bar corresponding to the bar 55 of 7′. Since the parts of the left hand portion 7″ of the twin clamp, as viewed in FIG. 7, are of the same construction as the respective parts of the right hand portion 7′, the same reference numerals are used for identical parts of both sides of the clamp.

Figure 5:
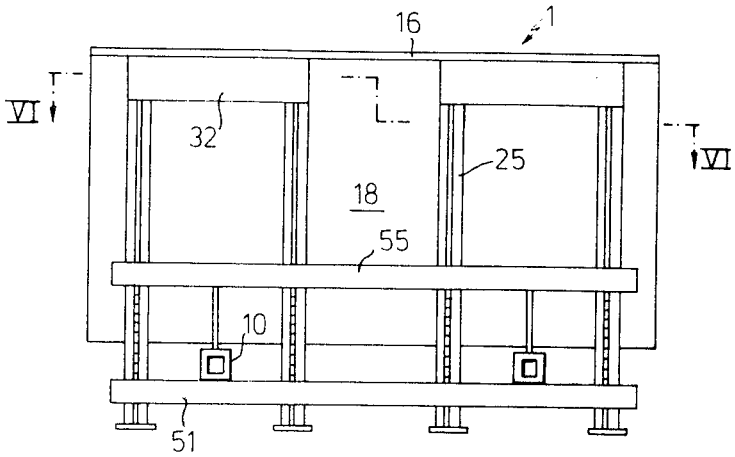
FIG. 5 illustrates the floor joist formwork as viewed in the direction of the arrow V in FIG. 2.

The component parts of the single clamp 43, shown in FIG. 8, have the same reference numerals as the corresponding parts in FIG. 7, even though the bars 51 and 55 of the clamp 43 are shorter than one half of the corresponding dimensions in FIG. 7. In FIGS. 5, 6 and 8, the wedge 12 used for locking the clamps has been omitted for clarity.

Figure 9:
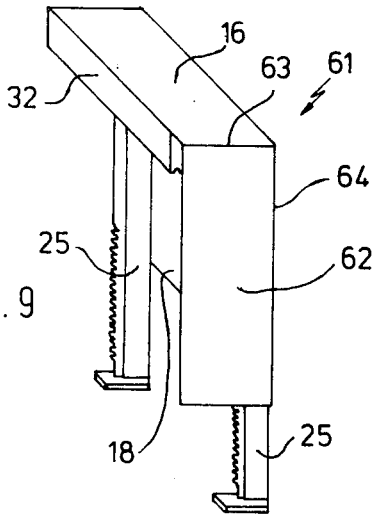
FIG. 9 is a perspective view of a side form element which is shorter than the one illustrated in the preceding Figures and is intended for forming the inside corner of two rectangularly abutting floor joists.

On a construction site, one will normally have available a certain quantity of ready-made side sheathing elements 1 of, for instance, 125 cm length. Where this length is excessive, two options are available: cutting off the portions of the sheathings 16, 18 which extend past the two outermost frame pieces 25, or, the pairs of frame pieces 25 each connected by a bar 32 may be so disposed that the distance between them is smaller than it is shown in FIG. 1. Finally, as the embodiment of FIG. 9 shows, the side form elements 61 may have only one pair of frame pieces 25 connected by a bar 32. The side form element 61 is provided, on its end facing the viewer, with an additional sheathing section 61 provided rectangularly to the plane of the sheathings 16 and 18 which in this embodiment are shorter than in the embodiment of FIG. 1. The sheathing section 62 forms edges 63 and 64 with the just mentioned sheathings 16 and 18. In the absence of this additional sheathing section 62, the side form element 61 may be used in the same manner as the side form elements 1. However, if the sheathing section 62 is present, the side form element 61 may be additionally used for shuttering floor joists rectangularly abutting against each other, as will be described in more detail hereafter.

Figure 10:
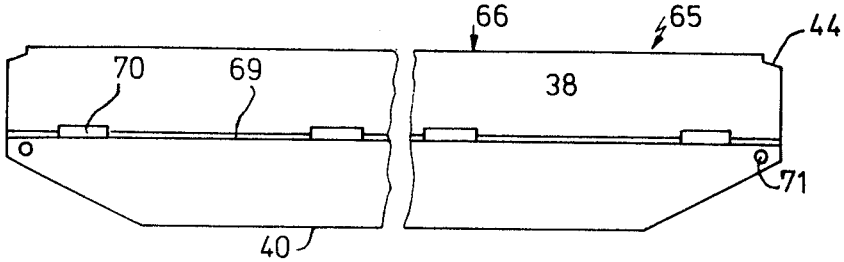
FIG. 10 is a side view of a ceiling beam on which the floor sheathing and the side form elements are suspended, the cross-section of the beam being visible in the upper right hand portion of FIG. 2.

FIG. 10 shows a ceiling or floor girder employed in one embodiment of the floor joist formwork according to the invention, also indicated in the upper right hand corner of FIG. 2. The girder 65 consists of a hollow aluminum section of the shape shown in FIG. 2. The top surface forms part of the form for the underside of the concrete floor or ceiling. Rectangularly joined to the top surface 66 are two parallel lateral surfaces 67 which slant toward each other beginning at about the middle of the section 65. From this point on they are designated by reference number 68. At about the center line of the aluminum girder section 65, outwardly projecting bar-shaped members 69 extend over the entire length of the girder 65 and carry spaced upwardly open hook-like projections 70. The spacing between the hook-like members 70 is smaller than the length of the bar 32 of the side form elements 1, 61. The end portions of the girder 65 are each provided with a transverse bolt 71 extending through the hollow interior of the section 65 and serving to hang the beam on a bulkhead with a hook. A beam similar to the instant girder and an appropriate bulkhead are disclosed in the German patent application P No. 30 04 245.6. Reference may be made to this patent application for further details, if necessary.

The thickness of the bar 32 of the side form elements 1, 2 and 61, measured perpendicularly to the plane of the sheathing 18, is of a magnitude as to permit the bar 32 to rest with its underside on the bar-shaped projection 69 of the girder 65. The hook-like structures 70 prevent the bar 32 from sliding down from the projection 69, which also has the shape of a bar. To enable the side form elements 1, 2, 61, regardless of the existence of the hook-like members 70, to be supported by the bar or flange 69 at any desired point along the girder 65, the frame pieces 30 are provided with a recess 75 to accommodate the shape of the hook-like member 70. Adjacent the recess 75 is another recess 76 having a lesser depth. This recess 76 is designed to permit the side form element to be supported by a bar-shaped member, which in the above-mentioned patent application has been described as extension profile.

Figure 11:
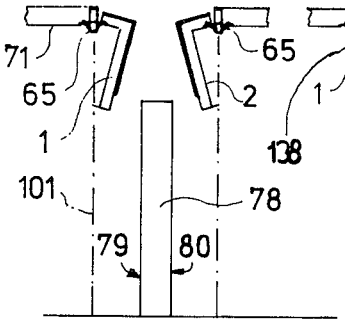
FIGS. 11 to 13 are schematic representations of the installation of a floor joist formwork in the area of a floor to be cast.
Figure 12:
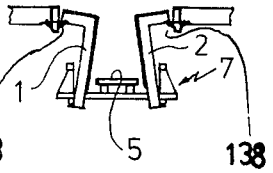
Figure 13:
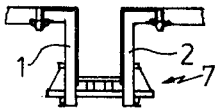

The erection of the formwork for a floor joist will now be described with reference to FIGS. 11–13. Suppose that the left hand girder 65 in FIG. 11 supported by a brace 101 at the height required for the concrete casting is secured against horizontal displacement transversely to its longitudinal axis by, for example, a floor or ceiling form element 71′ which on its left side is supported by the bar-shaped member 69 and extends above the hooks 70. The right hand floor girder 65 in FIG. 11, however, is still free to be slidably displaced somewhat in the mentioned direction. Now the side form elements 1 and 2 are hung by their bars 32 from the girder 65. Because the point of suspension is not above the point of gravity when the side form elements with their vertical sheathing 18 stand upright, the side form elements 1 and 2 turn in such a manner that their lower ends point outward, as it is shown in FIG. 11. The mounting of the side form elements on the floor girder 65 is so designed as to make the just described turning or pivotal movement possible. Hence, in order for the pivotal movement to occur always about the lower edge of the bar 32 at the point where it is resting on the bar-shaped projection 69, it is expedient to have the hook 70 in the embodiment of FIG. 2 not extend up to the upper end of the recess 75. Thereupon, a double clamp 7 (or a clamp 43) is prepared by assembling the two portions 7′ and 7″, with the bars 55 spaced at a distance such as to enable the double clamp 7 to be moved from below over the plates 42 and up on the frame pieces 25 as the two lower ends of the side form elements 1 and 2 are moved slightly toward each other by the tradesman. In doing this, the clamp 7 is lifted an amount such that the flanges 52 are moved into the range of the teeth 39. Then the double clamp 7 is raised until the long yoke sections 9 and the short yoke sections 10 abut the lower edge 20 of the vertical sheathings 18 of both the right and left side form elements. If necessary, the double clamp 7 is subsequently lowered somewhat until the flanges 52 are in a position to engage the next tooth spacing 40. Depending on the specific construction of the side form elements and particularly in view of their point of gravity with respect to the point of suspension, it may be expedient to reduce somewhat the spacing between the two yoke parts 7' and 7'', as it is indicated in FIG. 12, to ensure that the flanges 52 of the two parts 7' and 7'' are securely retained in the spaces 40 between the teeth 39. Any disengagement is prevented by the outward drift of the lower ends of the side form elements 1 and 2. Now, lengths of squared timber 3 are placed upon the long yoke sections 9 to support a sheathing 5, the width of which corresponds exactly to the width of the underside of the floor joist to be cast. The length of the sheathing 5 may extend over several successive side form elements, whereby the side form elements undergo an additional ranging so that their sheathings are in an extremely accurate flush relationship to each other. By further moving the two component parts of the double clamp 7 toward each other, the lower portions of vertical sheathings 18 are moved toward the neighbouring faces of the sheathing 5 functioning as an abutment by which the distance between the side form elements 1 and 2 in their lower region is determined. If the distance between the two floor girders 65 supporting the floor joist formwork may still have been somewhat too great prior to the just described movement, the right hand floor girder 65 in FIG. 11 is now moved to the left because its hooks 70 engage the bar 32 of the side form element 2. If desired, the mutually contrary movement of the two component parts of the double clamp 7 may be blocked when the side form elements have reached the positions relative to each other as illustrated in FIGS. 1 and 2. This is accomplished in the instant embodiment by inserting the wedge 12. If desired, the double clamp 7 may be so constructed that it may readily be pretensioned to counteract the pressure of the liquid concrete. The position in which the double clamp 7 is hung on the side form elements 2, which are approaching each other to a slightly greater extent, is shown in FIG. 12. FIG. 13 shows the floor joist formwork in its ready condition, with the side form elements and the double clamp being in their relative positions to each other, as it is indicated in FIG. 2. FIG. 11 further shows a concrete supporting member 78 for the completed floor joist. The width of the concrete post 78 corresponds to the width of the lower region of the floor joist. The vertical sheathings 18 of the two side form elements 1 and 2 lie flat against the upper region of the side walls 79 and 80 of the concrete post 78. The height of the concrete supporting member 78 is such that a sheathing 5 arranged in front of the concrete support member 78, as viewed in FIGS. 11–13, may be moved up and adhered to the side of the concrete post 78 facing the viewer. Similarly, this applies also to the back of the concrete post 78 facing away from the viewer. Hence, there is no sheathing 5 in the area above the concrete support 78, so that the finished floor joist is resting directly on the concrete supporting member 78 and may be additionally secured to it by reinforcing steel projecting from the upper end of the concrete post 78. If the concrete post 78 is narrower than the floor joist 83, spacers of the required thickness are attached to the sheathing 18 in the region of the concrete support 78. The upper side of such spacers form part of the sheathing surface for the underside of the floor joist.

By suitably cutting the vertical sheathing 18, the distance between the bottom edge 20 of the sheathing 18 and the plane of the sheathing 16 may be so selected as to produce the desired height of the floor joist, taking into consideration the thickness of the sheathing section 5 and a given height of the squared timbers 3.

Any pivotal movement of the frame pieces 25 from the position shown in FIG. 11 past the position shown in FIG. 13, in which the vertical sheathings 18 are parallel to one another, is not possible in this embodiment because when the sheathing 18 has reached the vertical position, the surface 33 of the bar 32 facing away from the sheathing 18 comes to lie against the adjacent surface 67 of the girder 65 so that these two abutting parts effectively form a stop. Also, the lower edge of the bar 32 is prevented by the hooks 70 from moving away from the surface 67. It is thereby made impossible for the double clamp 7 to fall down, even if in the completely erected formwork of FIG. 13 the sheathing 5 of the bottom form element is removed for some reason.

Figure 14:
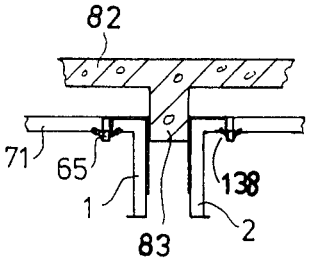
FIGS. 14 and 15 are schematic representations of the stripping of a floor joist formwork from the finished concrete ceiling.
Figure 15:
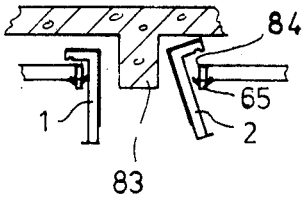

FIGS. 14 and 15 illustrate the dismantling of the floor joist formwork after completion of the casting of a concrete floor or ceiling 82 having a floor joist 83. Not illustrated is that, first, the double clamp 7 was removed from below by pulling apart its two component parts, and the squared timbers 3 and the sheathing 5 were removed. Because of the concrete floor 82 and the floor joist 83, the lower ends of the side form elements 1 and 2 are prevented from being moved into the position shown in FIG. 11. Then the bulkheads, not illustrated, holding up the floor girders 65 are lowered a distance which is greater than the height of the horizontal frame piece 15 of the side form elements 1, 2.

After lowering the girder 65, the side form elements 1, 2 are raised one by one so that the underside of the horizontal flank 15 is in a plane above the upper side 16 of the girder 65. Thereafter, the raised side form element is moved toward the girder 65 so that the horizontal flank 15 is now above the top surface 66 of the floor girder 65, as it is shown in the left hand portion of FIG. 15. The side form element may now be stripped by a pivotal movement from below, as indicated in the right hand portion of FIG. 15, through the space between the floor girder 65 and the floor joist 83, whereby the edge 35 formed by the sheathings 16 and 18 describes an approximately circular path about the longitudinal axis of the floor girder 65. Due to the ability of the horizontal flank 15 to be moved above the floor girder 65, the edge 35 is sufficiently spaced from the side face of the floor joist 83. The length of section 85 of the horizontal flank 15 projecting past the back side of the bar 38 in a direction facing away from the sheathing 18 is so dimensioned that, as the flank 15 is slidably moved above the girder 65, the sheathing 18 gains a sufficiently great distance from the side surface of the floor joist.

Figure 16:
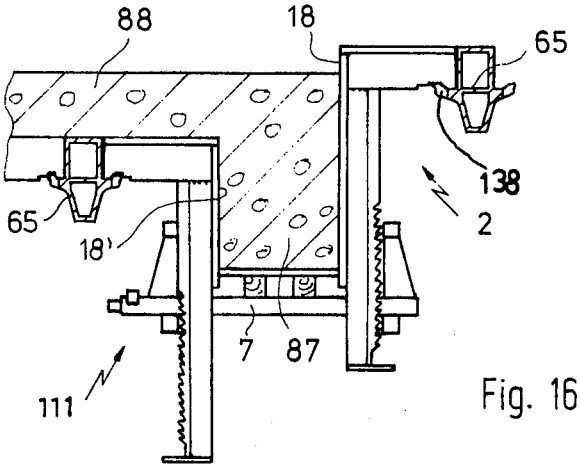
FIG. 16 is a view in a direction similar to FIG. 2, illustrating the use of a floor joist formwork in fabricating a marginal floor joist.

FIG. 16 shows a formwork for a marginal floor joist provided on the edge of a concrete floor or ceiling 88. It will be noted that the two side form elements 111, 2 are not of the same height. Rather, the floor girder 65 from which the right hand side element 2 in FIG. 16 is suspended, is at a higher elevation than the left hand floor girder 65. The upper region of the vertical sheathing 18 of the side form element 2 thus forms at the same time the lateral sheathing for the right hand end surface of the concrete ceiling 88. The side form element 111 differs from the side form element 2 only by the height of the sheathing 18' which is less than the height of the sheathing 18 of the form element 2, so that the lower edge of the sheathing 18' is at about the same level as that of the sheathing 18 of form element 2. The difference in height that may be realized by the two side form elements held together by a clamp 7 is determined by the length of the toothed section on the frame piece 25. In the illustrated embodiment, the possible maximum difference in height between the two side form elements 111, 2 is just about attained.

While a particular advantage of the formwork of the invention invention is the feature that the form may be assembled on location, i.e. at the site of casting of the floor joist, is is also possible to relocate the completely assembled form illustrated in FIGS. 1 and 2, if that should be desirable. This is possible because the sheathing 5 of the bottom form element is disposed at a level above the bar 51 and below the bar 55, which have their surfaces 88 and 89 neighbouring the frame piece 25 in abutting relationship with the bar 38 or with the outwardly projecting end of the teeth 39. So, the side form elements 1, 2 are prevented from being moved about one of the bars 51, 55 nor about the front face of the sheathing 5, so that the structure illustrated in FIGS. 1, 2 is completely stable in itself and need not be suspended from floor girders 65.

Figure 17:
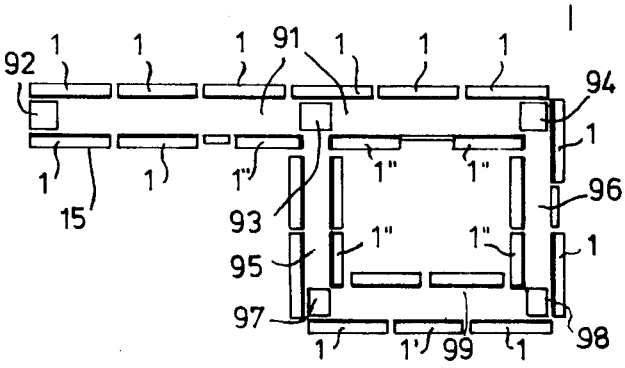
FIG. 17 is a simplified top plan view of a system of joist forms for forming a plurality of floor joists rectangularly disposed to each other and supported by concrete columns.

If a floor or ceiling is provided only with floor joists which are parallel to each other, the side form elements for the floor joists may be so disposed, without difficulty, that they are almost exactly opposite each other, as it is shown in FIG. 1. However, this particular arrangement of the side form elements is not at all required in the application contemplated. If a floor joist is rectangular to another floor joist, it is generally not possible for the continuous member to position the side form elements for forming the two lateral surfaces of the floor joist exactly opposite each other. This situation is illustrated in FIG. 17 which is a schematic top plan view of the arrangement of various side form elements for shuttering a ceiling comprising a long floor joist 91 which is supported at its ends and at the center by concrete supporting members 92, 93, 94. Branching off from the center and one end of the floor joist 91 at right angles are shorter floor joists 95 and 96 whose ends likewise are supported by concrete supports 97 and 98 and are linked by a floor joist 99 which extends parallel to the floor joist 91. To more clearly distinguish the successive side form elements, small spaces are shown in the drawing between the side form elements. The side form elements 1 are all of the same length. The side form elements 1' are shorter and may, in fact, vary in length. The vertical sheathing 18 is in each instance indicated by a bold line. Also shown in bold lines are the sheathings 62 of those side form elements 1'' which have a sheathing section extending vertically and rectangularly to the sheathing 18 (FIG. 9). Also indicated is the horizontal flank 15. In places where only relatively small gaps remain between adjacent side form elements, such gaps are closed by some sheathing material which is merely outlined in the drawings. The arrangement of the double clamps or of single clamps is not shown. Where possible, the use of double clamps 7 is preferred; where there is not enough space for double clamps, single clamps 43 are indicated.

Figure 18:
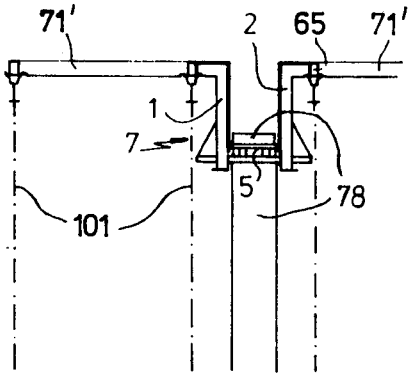
FIG. 18 shows a detail.

FIG. 18 shows the floor joist formwork, ready for use, in the region of the concrete supporting member 78. The upper end of the concrete member 78 extends slightly above the plane of the horizontal sheathing 5. The sheathing surfaces of the side form elements 1 and 2 lie against the lateral surfaces of the concrete supporting member 78, such lateral surfaces being perpendicular to the plane of the drawing.

Figure 19:
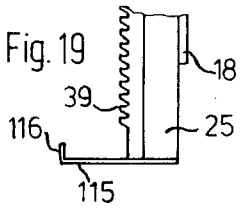
FIG. 19 shows a modification of the lower end of the side form elements.

FIG. 19 illustrates another embodiment of the lower end of the frame piece 25 of the side form elements 1, 2. Instead of the shoe plate 42 (FIG. 2), a plate 115 is provided which projects farther to the rear and the free end 116 of which forms an upward open hook. The length of the portion of the plate 115 extending rearwardly from the teeth 39 is so dimensioned that, while mounting the formwork to the suspended side form elements 1, 2, the clamp 7 may temporarily be hung from the hook 116 before raising it to the desired level. With the clamp 7 hung up on the hook 116, the hook 116 engages behind the bar 51 so that the clamp 7 is securely retained by the hook 116 and is prevented from sliding off the plate 115, even if, during installation of the formwork, the side form elements 1 and 2, still in a slanting position, are subjected to some strong impact forces which would tend to swing them into the position shown in FIG. 13.

The length of the side form elements 1, measured in the direction of the floor joist to be constructed, is 125 cm in the described embodiment, the height of the side form elements measured from the shoe plate 42 is 80 cm, the width of the upper sheathing 16 is 25 cm, and the portion 85 of the horizontal frame piece 15, which projects past the bar 38, has a width of 14 cm. The bars 51 and 55 are constituted by hollow square sections having an edge length of 4 cm. The long yoke section 9 consists of a hollow square section having an edge length of 6 cm, and the edge length of the short yoke section 10 is 7 cm. The lateral surfaces of the hollow sections constituting the yoke sections 9 and 10 lie in a horizontal and a vertical plane, respectively. As previously described, it may be of advantage if the inner width of the yoke section 10 is substantially greater than the outer width of the yoke section 9 (this width is measured in the horizontal direction). Any tolerance or play in the vertical direction, however, should be avoided, at least in the finished erected form, to enable the clamp portions to remain in their fixed angular position, as shown in FIG. 2. In the clamp 43, the bars 51 and 55 have a length of 41 cm, and in the double clamp 7, these bars have a length of 124 cm. In the described embodiment, the form elements are so dimensioned that they are suitable for floor joists of up to 55 cm height (plus the thickness of the floor) and 60 cm width. With these measurements, it is possible to accommodate most orders for floor joist construction. The metal components in this particular embodiment are made of steel. If in another embodiment of the invention aluminum is used, the side form elements and the clamp may have a substantially lower weight, but then it should be borne in mind that for reasons of statics variations in the various dimensions may be required.

It will be understood that the cited measurements are given by way of example only, and that other measurements may be selected, depending on the particular application contemplated and in accordance with the requirements of statics.

Figure 20:
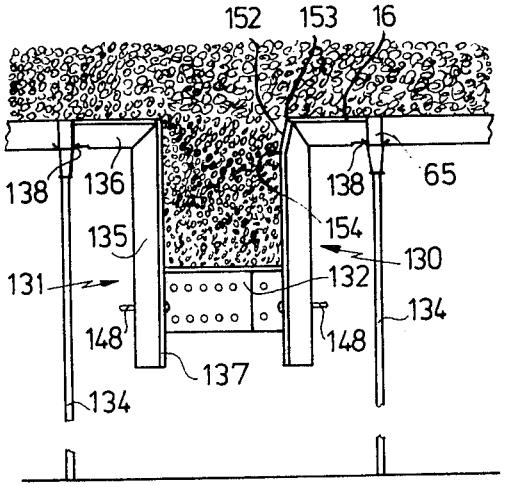
FIG. 20 shows a sectional view, in reduced scale, of another embodiment of the floor joist formwork of the invention, after casting of the floor joist.

In the embodiment of the invention shown in FIGS. 20 to 24, the lower ends of the side form elements 130 and 131 are not, as in the embodiments described heretofore, held together by a clamp-like device embracing the said ends. Rather, they are fastened by means of appropriate fastening means to the bottom 132 of the formwork. The side form elements 130 and 131 are provided each with two spaced frame pieces 133 made from a hollow boxshaped metal section and comprising a vertical leg 135 and a horizontal leg 136. A sheathing 137 riveted to the inner face of the vertical leg 135 extends downwardly over a length great enough to ensure that even in the case of floor joists of the maximum height for which the formwork is still intended, it will reach down to the lower edge of the floor joist. As shown in FIG. 20, the sheathing 137 may also extend down to the lower end of the vertical leg 135 of the frame pieces 133.

Figure 22:
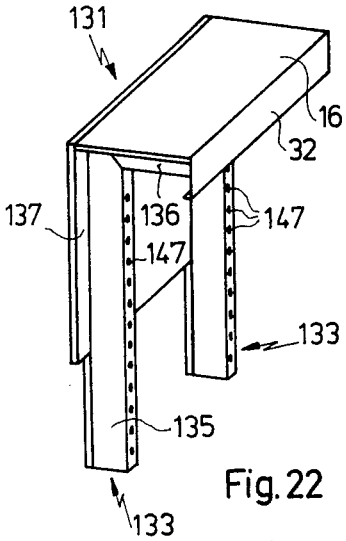
FIG. 22 is a perspective view of the side form element shown in FIG. 20

In FIG. 22, there is a distance between the lower end of the sheathing 137 and the lower end of the frame piece 133. The downward extension of the sheathing may be such that the lower edge of the sheathing rests against the upper edge of the bottom form element when the latter is fastened to the frame pieces 135 in its lowermost position.

On the horizontal legs 136 which are welded to the vertical legs of the frame pieces 133, another sheathing 16 is fastened which forms part of the floor formwork. Arranged adjacent to the outer longitudinal edge of the sheathing 16 is a downwardly directed bar 32 corresponding to the bar 32 in the embodiment of FIG. 1. The end faces of the horizontal section of the side elements 130, 131 are again provided with bars 30 exhibiting the same recesses 75 and 76 as the embodiment of FIG. 1 which are, however, not shown in FIG. 22. The recesses 75 and 76 and the lower edge of the bar 32 fastened to the end faces of the horizontal legs 136 serve to suspend the side elements on the neighbouring girder 65 or a neighbouring bulkhead of a brace 134. As in the embodiment shown in FIGS. 1 to 19, the recesses 75, 76 and the lower edge of the bar 32 define the pivot axis 133 with which the side form elements 130 and 131 can be pivoted during the installation and stripping work.

Figure 23:
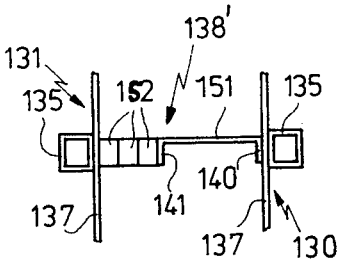
FIG. 23.
Figure 24:
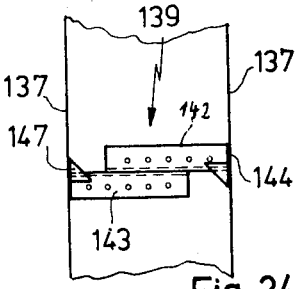
FIG. 24 are top plan views of different embodiments of a bottom supporting element.

The bottom 132 of the floor joist formwork is formed by a sheathing supported on the bottom-supporting elements 138' and 139 of which a plan view is given in FIGS. 23 and 24. The bottom-supporting element 138' comprises a U-shaped sheet member 151—viewed from above—whose one leg 140 is applied against the sheathing 137 of the side form element 130 and whose other leg 141 would in those cases in which the width of the floor joist corresponds to the crossbar width of the U-shaped sheet member 151, be applied against the sheathing 137 of the side form element 131. If, however, the width of the floor joist is greater, a number of, for instance, three wooden spacers 152 or the like are arranged between the leg 141 and the sheathing of the side form element 131.

In the embodiment shown in FIG. 24 the bottom supporting element comprises likewise two sheets 142 and 143 of U-shaped cross-section, which have their cross pieces in contact with each other and their legs projecting in opposite directions. The U-shaped cross-section of the sheets 142 and 143 of the embodiment of the invention extends in the vertical direction, whereas the U-shaped cross-section of the sheet 151 of the embodiment shown in FIG. 23 extends vertically.

The end faces of the sheets 142 and 143 opposite the sheathings 137 are provided with face plates 144 bearing against the sheathings 137. A cross piece of the sheet 142 is provided with two rows of holes 145 arranged one above the other, whereas reference number 146 designates similar rows of holes in the cross piece of the sheet 143. The distance between the individual holes of the rows of holes 145 is, however, a little smaller than that between the holes in the rows 146 so that the length of the bottom supporting element 139 can be adjusted in very small steps by introducing screws into aligned holes in the two sheets.

In the vertical legs 135 there are disposed regularly spaced holes 147 which also pass through the sheathing 137. Likewise, holes are provided in the face plates 144 of the bottom supporting element 139 and in the legs 140 and 141 and in the spacers 142. However, the distance between these holes is a little smaller than the distance between the holes 147. The said holes and the holes 147 serve to receive the fastening means for fastening the bottom supporting elements 138', 139 to the side form elements 130 and 131. Such fastening means may, for instance, consist in a keybolt 148 which is tightened by a wedge 19 engaging a slot of its outer end. The fastening means may also consist of screws or the like, including tie rods which would then extend from the outer face of the vertical leg 135 of the side form element 131 to the outer face of the vertical leg 135 of the side form element 130 and have their ends engaged by suitable fastening means to press the side form element 130 and 131 against the end faces of the bottom supporting elements 138' and 139. The means for fastening the bottom supporting elements 138 and 139 to the side form elements 130 and 131 should, however, be detachable for stripping purposes so that when stripping the floor joist formwork the latter can be taken apart so that it can be easily handled by a single man. If the side form elements 130 and 131 are to be removed first and the bottom form element of the floor joist is to remain in place for some time, for instance until the concrete has gained a certain bearing strength, the bottom supporting elements 138' and 139 are, prior to releasing the fastening means 148, supported by additional braces, for instance the braces 149'. The latter support the longitudinal girder 150 on which rest the bottom supporting elements 138' and 139.

Figure 21:
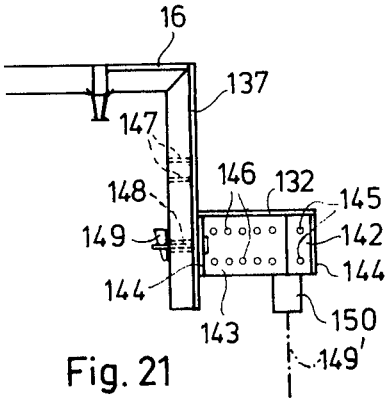
FIG. 21 shows a section of the formwork after installation of one side of the form only.

The supporting structure 149', 150 is, however, not only required when the bottom form element of the floor joist is to remain in place although the side form elements 130 and 131 are removed, but also when, as shown in FIG. 21, only the side form element 131 is initially suspended on the ceiling formwork whereupon the bottom supporting elements 138' and 139 and the bottom form element 132 are installed, while the side form element 130 is still missing. In the state of the shuttering work shown in FIG. 21, i.e. when the side form element 130 is still missing, the reinforcement for the floor joist can be put in place from the side which would otherwise be closed by the side form element 130. The supporting structure 149', 150 provided in this case and bearing against the underside of the bottom supporting elements 138, 139 is, however, not necessary when according to FIG. 11 both side form elements have been suspended on the ceiling formwork and the formwork bottom is fastened on both side form elements before the bottom 132 is loaded.

Stripping of the side form elements 130 and 131 is effected by first releasing the fastening means 148 and then pivoting the elements about the pivot axis 138. To enable and facilitate such a pivotal movement, the side form element 130 is provided on its upper edge with a haunch portion 152. The edges 153 and 154 formed between the said haunch portion 152 and the horizontally extending sheathing 16 on the one hand and the vertically sheathing 137 on the other hand, are arranged on an arc of a circle having its center in the pivot axis 138. This enables the side form element 130 to be pivoted about the axis 138 and removed even when the pivot axis 138 extends at the lower outermost edge of the horizontal leg 136 and when the longitudinal girder 65 has not been lowered by means of a bulkhead. In this case, too, a small stripping play may be provided, although the necessary play is generally available in ceiling formworks in the direction of the forming plane, in particular when part of the formwork has been removed already. In practice, this is so in most of the cases as the formwork of the ceiling joist is often left in place for a period longer than the ceiling formwork. But even when only the side form elements are to be removed from the floor joist formwork, while the ceiling formwork is to remain in place, the minimum play normally available will suffice when the side form elements 130 are provided with the haunch portion 152 according to this embodiment of the invention. If, however, the side form element 131 does not have the haunch portion 152, it is convenient to lower the longitudinal girder 65 with the aid of a bulkhead—FIG. 15—before removing the side form element 131 in the manner described with reference to FIG. 15.

Those holes 147 which are within the area of the section of the sheathing 137 which is in contact with the concrete, are closed by means of plugs.

In this embodiment of the invention it is also ensured that all elements of the floor joist formwork can be manually handled during erection and stripping, and produced in dimensions suitable for being installed and removed by a single unskilled worker. Even when stripping the formwork without the supporting structure 149', 150, all parts are secured from falling down as after releasing the fastening means 148 the bottom form element will come off first, whereas the side form elements are still suspended on the ceiling. Due to the fact that the sheathing extends over the full length of the maximum height of the floor joist, the sheathings will remain on their supports even when constructing lower floor joists so that the length covered with the sheathing need not be adapted in each case to the height of the floor joist and the side form element can be used also for the construction of marginal floor joists and corners, without the need to fit in separate sheathing cuts. In addition, this design is extremely stiff to bending due to the relatively high bottom supporting elements 138, 139.

The forming surface of the legs 135 of the girders 133 of the side form element 130 which extends in parallel to the lateral faces of the floor joist and perpendicularly to its longitudinal axis extends vertically to the perpendicular drawn from the edge formed between the said leg 135 and the leg 136 extending in parallel to the ceiling formwork, to the pivot axis 138.

I claim:

1. A formwork structure for casting a concrete floor provided with a floor joist, said structure comprising generally horizontal floor form means for supporting and casting the concrete floor, a pair of side form elements for casting the sides of the floor joist, each of said side form elements having frame members and side sheathing fastened to said frame members, a bottom form for extending between said side form elements to cast the bottom of the floor joist, and releasable fastening means extending between said side form elements for interconnecting said side form elements with said bottom form secured therebetween, said fastening means being releasable for stripping the side form elements and the bottom form from the cast concrete floor joist, said floor form means having a pair of upwardly facing hook shaped hanger means for pivotally suspending said side form elements, said side form elements having respective upper portions with respective downwardly facing hook shaped hanger means thereon for disengageably and pivotally resting upon the respective upwardly facing hook shaped hanger means, said upwardly and downwardly facing hook shaped hanger means defining a pair of pivot axes about which said side form elements are swingably and disengageably suspended for easy stripping from the cast floor joist by swinging movement and removal of said side form elements from said upwardly facing hook shaped hanger means.

2. A formwork structure according to claim 1, in which said upper portion of each of said side form elements comprises a laterally projecting generally horizontal flank projection forming an extension of said floor form means, said downwardly facing hook shaped hanger means being provided on said flank projection for removably engaging the corresponding upwardly facing hook shaped hanger means on said floor form means.

3. A formwork structure according to claim 2, in which each of said flank projections has a lateral extremity which is remote from the sheathing of the corresponding side form element, said downwardly facing hook shaped hanger means being in the direct neighborhood of said extremity.

4. A formwork structure according to claim 2, said flank projection having upwardly facing sheathing thereon, said downwardly facing hook shaped hanger means being in the direct neighborhood of said sheathing on said flank projection.

5. The formwork structure according to claim 1, said floor form means having upwardly facing sheathing thereon, said upwardly facing hook shaped hanger means being spaced downwardly from said sheathing on said floor form means.

6. A formwork structure according to claim 2, said flank projection of each of said side form elements having upwardly facing sheathing thereon, said flank projection having a lateral extremity remote from the side sheathing of the corresponding side form element, said downwardly facing hook shaped hanger means being spaced downwardly from said sheathing on said flank projection and in the neighborhood of said extremity.

7. A formwork structure according to claim 2, the flank projection of each of said form elements having upwardly facing generally horizontal sheathing thereon, each of said side form elements having a transitional portion extending between the horizontal sheathing on said flank projection and the side sheathing, said transitional portion comprising a sloping face between said side sheathing and said horizontal sheathing.

8. A formwork structure according to claim 1,
said floor form means including a pair of girders,
said upwardly facing hook shaped hanger means being provided on said girders.

9. A formwork structure according to claim 2,
said flank projection of each of said side form elements having downwardly facing surface means for engaging the upper side of said floor form means after dismantling movement of said floor form means downwardly away from the cast concrete floor and laterally away from the floor joist,
each of said side form elements being removable from the floor form means by swinging the side form element away from the floor joist and withdrawing the flank projection from the space between the floor joist and the floor form means.

10. A formwork structure according to claim 1,
including cooperative stop means on said floor form means and said side form elements for limiting the swinging movement of the side form elements toward their positions of use to cast the sides of the floor joist.

11. A formwork structure according to claim 10,
said stop means comprising cooperatively engageable side surfaces on said floor form means and said side form elements.

12. A formwork structure according to claim 1,
said floor form means including floor girders having upwardly facing sheathing thereon,
said upwardly facing hook shaped hanger means comprising upwardly open hooks on said floor girders and spaced downwardly from the sheathing thereon.

13. A formwork structure according to claim 2,
said upwardly facing hook shaped hanger means comprising upwardly open hooks on said floor form means,
said downwardly facing hook shaped hanger means comprising bars projecting downwardly from said flank projections for pivotal engagement with said hooks.

14. A formwork structure according to claim 13,
including crossbars extending between said bars and the frame members of the side form elements,
said crossbars having downwardly facing recesses for receiving the hooks.

15. A formwork structure according to claim 14,
said crossbars having second downwardly facing recesses formed therein adjacent said first mentioned recesses,
said second recesses being less deep than said first mentioned recesses.

16. A formwork structure according to claim 1,
said bottom form being longer than said side form elements.

17. A formwork structure according to claim 1,
said side sheathing on said side form elements having bearing strips thereon to support said bottom form.

18. A formwork structure according to claim 1, comprising
floor joist clamps for mounting on lower portions of said side form elements to prevent spreading of said side form elements,
said clamps comprising yokes having means for adjusting the effective length of said yokes,
said yokes being movable upwardly from below into their positions of mounting on said side form elements.

19. A formwork structure according to claim 18,
each of said yokes comprising telescopically slidable sections and means for locking said sections together.

20. A formwork structure according to claim 18,
each of said yokes comprising a yoke rod and two sections slidable and lockable thereon.

21. A formwork structure according to claim 20,
each of said yokes comprising a tie rod extending along the axis of the yoke for locking said sections of the yoke.

22. A formwork structure according to claim 18,
in which each of said yokes comprises a short section and a longer section,
said short section being slidably disposed in an overlapping relationship to said longer section,
said short section having a stirrup thereon opposite a portion of said longer section,
and a wedge received in said stirrup for acting upon the longer yoke section to lock said sections together.

23. A formwork structure according to claim 18,
said bottom form being disposed between said side form elements and being clamped therebetween by said clamp.

24. A formwork structure according to claim 18,
said frame members of said side form elements comprising extensions extending downwardly past the lower ends of the side sheathing.

25. A formwork section according to claim 19,
each of said side form elements comprising a plurality of vertically spaced teeth for selecting the elevation of the bottom form.

26. A formwork structure according to claim 25,
in which said telescopically slidable sections of the yoke have bars on said sections extending transversely thereto and receivable between said teeth in engagement therewith.

27. A formwork structure according to claim 25,
in which said teeth are provided on said frame members of said side form elements.

28. A formwork structure according to claim 24,
in which said yokes of said clamps are applied to said extensions of said frame members.

29. A formwork structure according to claim 19,
in which said sections of said clamp comprise upwardly projecting stop means extending at a fixed angle to the longitudinal axis of the yoke and engageable with said side form elements for clamping said side form elements between said stop means with the sheathing of said side form elements at the desired angle to the bottom form.

30. A formwork structure according to claim 29,
said stop means comprising bars extending transversely to the longitudinal axis of said yoke.

31. A formwork structure according to claim 29,
said stop means comprising two stops on each of said telescopically slidable sections for engaging the corresponding side form element at different levels.

32. A formwork structure according to claim 31,
in which one of said two stops is engageable with the corresponding side form element above the upper side of the bottom form, the other stop being engageable with the corresponding side form element below the upper side of the bottom form.

33. A formwork structure according to claim 26, in which each of said tooth engaging bars is connected between an adjacent pair of said clamps.

34. A formwork structure according to claim 29, said stop means comprising a bar connected between corresponding sections of two adjacent clamps, said bar being spaced above the yokes of said adjacent clamps and extending transversely to the longitudinal axes of said last mentioned yokes.

35. A formwork structure according to claim 18, said bottom form being supported by the yokes of said clamps.

36. A formwork structure according to claim 26, said frame members of said side form elements including vertical members on which said teeth are provided, each of said vertical members including a lower extremity having a shoe member projecting laterally beyond the length of said teeth.

37. A formwork structure according to claim 1, said releasable fastening means comprising bottom supporting members extending between and abutting against the two side form elements, said releasable fastening means including releasable fastening elements connected between the ends of the bottom supporting members and the abutting side form elements, said releasable fastening elements being readily releasable for stripping said side form elements away from the cast concrete floor joist.

38. A formwork structure according to claim 37, said side form elements and said bottom supporting members being provided with holes for receiving said releasable fastening elements, said holes extending through the frame members and the sheathing of said side form elements.

39. A formwork structure according to claim 38, said holes being arranged in generally vertical rows to provide for adjustment of the elevation of said bottom supporting members, said side sheathing on said side form elements extending down to an elevation corresponding generally to the upper extremities of said bottom supporting members when adjusted to their lowermost elevation.

40. A formwork structure according to claim 38, said holes in said side form elements and said bottom supporting members being arranged in generally vertical rows to provide for adjustment of the elevation of said bottom supporting members, said holes in said bottom supporting members being spaced apart by a distance which is different from the spacing distance between said holes in said side form elements to provide for fine adjustment of the elevation of said bottom supporting members.

41. A formwork structure according to claim 37, each of said bottom supporting members comprising two adjustable overlapping plates for adjusting the length of said bottom supporting members, said plates having generally horizontal rows of holes therein with fasteners extending through some of said holes, said holes in the generally horizontal rows in the two plates having different spacing distances to provide for fine adjustment of the length of said bottom supporting members.

42. A formwork structure for casting a concrete floor to be provided with an integral downwardly projecting floor joist, said structure comprising a pair of generally horizontal floor forms for supporting and casting the concrete floor, said floor forms having a space therebetween where the floor joist is to be provided, a pair of left and right hand side form elements removably receivable in said space for casting the sides of the floor joist, each of said side form elements having frame members and generally vertical sheathing fastened to said frame members, a generally horizontal bottom form for extending between said side form elements to cast the bottom of the floor joist, said bottom form being disposed at an elevation lower than the elevation of said floor form, and releasable fastening means extending between said side form elements for interconnecting said side form elements with said bottom form secured therebetween, said fastening means being releasable for stripping the side form elements and the bottom form from the cast concrete floor joist, said floor forms having girders with generally horizontal sheathing fastened thereon, said girders being adjacent opposite sides of said space between said floor forms, said girders on said floor forms having a pair of upwardly facing hook-shaped hanger means thereon for pivotally suspending said side form elements, each of said side form elements having a cross-sectional shape corresponding generally to an inverted L, each of said side form elements having an upper portion comprising a laterally and outwardly projecting generally horizontal flank projection having generally horizontal sheathing thereon at substantially the same level as the horizontal sheathing of said floor forms, said flank projections extending in left and right hand directions on said respective left and right hand side form elements, said flank projections of said side form elements having downwardly facing hook-shaped hanger means thereon for disengageably and pivotally resting upon the respective upwardly facing hook-shaped hanger means on said floor forms, said upwardly and downwardly facing hook-shaped hanger means defining a pair of pivot axes about which said side form elements are swingably and disengageably suspended for easy stripping from the cast floor joist by swinging movement and removal of the side form elements from the upwardly facing hook-shaped hanger means.

43. A formwork structure according to claim 42, each of said side form elements having a transitional portion extending between the horizontal sheathing on said flank projection and the side sheathing, said transitional portion comprising a sloping face between said side sheathing and said horizontal sheathing, said transitional portion facilitating the stripping of said side form elements from the cast floor joist by downward swinging movement of said side form elements about said pivot axes.

44. A formwork structure for casting a concrete floor to be provided with an integral downwardly projecting floor joist, said structure comprising a pair of generally horizontal floor forms for supporting and casting the concrete floor, said floor forms having a space therebetween where the floor joist is to be provided, a pair of left and right hand side form elements removably receivable in said space for casting the sides of the floor joist, each of said side form elements having frame members and generally vertical sheathing fastened to said frame members, a generally horizontal bottom form for extending between said side form elements to cast the bottom of the floor joist, said bottom form being disposed at an elevation lower than the elevation of said floor form, and releasable fastening means extending between said side form elements for interconnecting said side form elements with said bottom form secured therebetween, said fastening means being releasable for stripping the side form elements and the bottom form from the cast concrete floor joist, said floor forms having girders with generally horizontal sheathing fastened thereon, said girders being adjacent opposite sides of said space between said floor forms, said girders on said floor forms having a pair of upwardly facing hook-spaced hanger means thereon for pivotally suspending said side form elements, each of said side form elements having a cross-sectional shape corresponding generally to an inverted L, each of said side form elements having an upper portion comprising a laterally and outwardly projecting generally horizontal flank projection having generally horizontal sheathing thereon at substantially the same level as the horizontal sheathing of said floor forms, said flank projections extending in left and right hand directions on said respective left and right hand side form elements, said flank projections of said side form elements having downwardly facing hook-spaced hanger means thereon for disengageably and pivotally resting upon the respective upwardly facing hook-shaped hanger means on said floor forms, said upwardly and downwardly facing hook-shaped hanger means defining a pair of pivot axes about which said side form elements are swingably and disengageably suspended for easy stripping from the cast floor joist by swinging movement and removal of the side form elements from the upwardly facing hook-shaped hanger means, said upwardly facing hook-shaped hanger means comprising upwardly open hooks on said girders of said floor forms, said downwardly facing hook-shaped hanger means comprising bars projecting downwardly from said flank projections for pivotal engagement with said hooks.

45. A formwork structure according to claim 44, each of said side form elements having a transitional portion extending between the generally vertical side sheathing and the generally horizontal sheathing on said flank projection, said transitional portion comprising a sloping face between said side sheathing and said horizontal sheathing to facilitate stripping of the side form elements from the cast floor joist by downward swinging movement of said side form elements about said pivot axes.

* * * * *